United States Patent [19]

Kobylinski

[11] 4,364,545

[45] Dec. 21, 1982

[54] WELL SERVICING APPARATUS

[75] Inventor: Lee S. Kobylinski, Bartlesville, Okla.

[73] Assignee: TRW Inc., Cleveland, Ohio

[21] Appl. No.: 164,519

[22] Filed: Jul. 2, 1980

[51] Int. Cl.[3] ..... B66D 1/36

[52] U.S. Cl. ..... 254/284; 212/233; 212/270; 254/334

[58] Field of Search ..... 254/283, 284, 285, 326, 254/325, 324, 338, 280, 281, 334; 212/194, 233, 270, 279

[56] References Cited

U.S. PATENT DOCUMENTS

| | | | |
|---|---|---|---|
| 992,527 | 5/1911 | Wigle | 254/285 |
| 1,116,427 | 11/1914 | Horton et al. | 212/233 |
| 1,933,472 | 10/1933 | DeVou | 254/280 |
| 2,128,712 | 8/1938 | Neff | 254/285 X |
| 2,326,556 | 8/1940 | Opsal | 254/339 X |
| 2,361,053 | 10/1944 | Pedersen et al. | 212/194 |
| 2,438,277 | 3/1948 | Fife et al. | 254/386 |
| 2,595,307 | 5/1952 | Selberg | 254/326 X |
| 2,742,260 | 4/1956 | Patterson | 254/390 |
| 3,050,285 | 8/1962 | Troyer | 254/285 |
| 3,101,816 | 5/1960 | Fox | 254/399 |
| 3,991,978 | 11/1976 | Jones | 254/335 |
| 4,050,587 | 9/1977 | Moen | 254/325 |

*Primary Examiner*—Billy S. Taylor

*Attorney, Agent, or Firm*—Shapiro and Shapiro

[57] ABSTRACT

A suspension structure is disclosed for use in running well hardware such as a pumping assembly by cable into a well and pulling the hardware from the well, the structure including two suspension masts. One of the masts is a lightweight mast having a working height sufficient to suspend the hardware above a well platform or the like on which the masts are mounted but not having a load capacity sufficient to withstand the forces required to pull the hardware from the well. The other mast is a short mast of high-load capacity capable of withstanding such forces but not of sufficient height to suspend the hardware. The two masts are used alternatively for running and pulling operations.

1 Claim, 4 Drawing Figures

WELL SERVICING APPARATUS

BACKGROUND OF THE INVENTION

The invention relates generally to well servicing apparatus and more particularly for running well hardware such as a pump assembly or the like, by cable, into a well and pulling such hardware from the well.

Typical oil well pulling and running equipment, for example, includes an elongated suspension boom or mast from which cable is run into the well and associated sheaves, winching equipment, etc. for driving the cable. The mast must have a height above a platform or other surface upon which it is mounted at a well head sufficient to suspend the well hardware for servicing, assembly and the like, and the mast must further have sufficient strength to withstand the forces encountered in pulling the hardware from a well. Oil well pumping assemblies can, for example, have a height approaching 50 feet, and the forces involved in pulling such assemblies from a well can reach as high as 250,000 to 300,000 pounds.

To meet the requirement of adequate strength to withstand pulling forces in a mast of sufficient length to accommodate the well hardware, typical masts and their associated supports have therefore been of extremely heavy and robust construction. Such structures are costly to manufacture and, due to their weight, energy-inefficient to transport, erect, and dismantle. This invention seeks to provide an alternative approach to the problem of combining in a well pull-and-run suspension structure, the facility for accommodating relatively tall well hardware assemblies with the capability of withstanding the forces encountered in pulling such hardware from a well.

SUMMARY OF THE INVENTION

It is an object of the invention to provide a novel form of suspension structure for use in running and pulling well hardware.

Another object of the invention is to provide a pull-and-run suspension structure, particularly for oil well and like uses, which is lighter in weight than typical suspension masts previously used for this purpose.

A further object of the invention is to provide a well pull-and-run suspension structure which combines, in a novel manner, the facility for suspending above a surface upon which the structure is mounted, relatively tall well hardware assemblies, with the capability of withstanding the high forces encountered in pulling such hardware from a well.

In accordance with the invention, at least in a preferred embodiment, a suspension structure for use in pulling and running well hardware by cable and the like includes a pair of mast assemblies mounted on a common surface. A first mast assembly includes a relatively long and lightweight mast, not necessarily capable of withstanding the maximum forces encountered in pulling well hardware from a well, but of sufficient height to suspend such hardware above the surface upon which the assemblies are mounted. A second mast assembly includes a relatively short and robust mast capable of withstanding the forces encountered in pulling the well hardware, but not necessarily of sufficient height to suspend the hardware above the mounting surface.

The structure may include a relatively low-powered cable winching system for the first mast assembly suitable for supporting the weight of the well hardware and a high-powered cable winching system, conveniently of a conventional hydraulic type, for the second mast assembly, for use in pulling well hardware from a well. With this arrangement, and suitable cable windings and attachments, the well hardware can be assembled and serviced in situ using the first mast. For running the hardware into the well it may first be lowered from this first mast and then, when at a suitable level, transferred to the second mast for conventional running and pulling. Upon completion of a pulling operation by the second mast, support of the hardware can then again be transferred to the first mast so that the hardware can again be lifted to a suitable level for servicing, etc.

Since, in the inventive arrangement, the second mast does not have to provide the required strength to withstand the pulling force over as great a length as in conventional single-mast systems, this mast can have a smaller cross sectional dimension than single mast arrangements used heretofore. The present arrangement may result in increased stability and reduced weight in the overall structure as compared with previous single mast systems and also, due to the use of a shorter mast for running and pulling, results in less exposed cable when the hardware is downwell.

The invention also contemplates a novel method of running and pulling well hardware by cable by alternating the pulling force between a pair of mast assemblies.

BRIEF DESCRIPTION OF DRAWINGS

Exemplary embodiments of the invention are illustrated in the accompanying drawings in which.

Like reference numerals are used in the respective figures to designate equivalent components.

DESCRIPTION OF PREFERRED EMBODIMENTS

Figure 1:
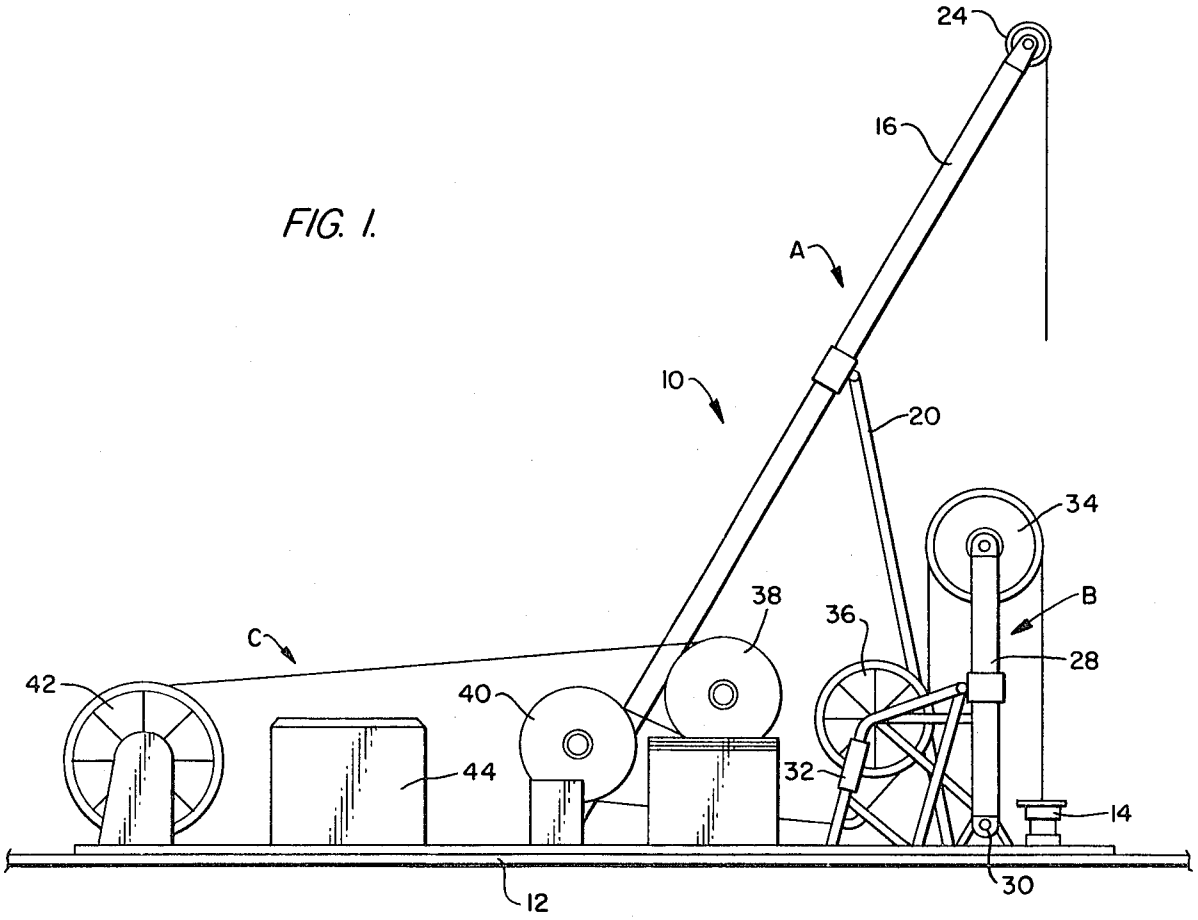
FIG. 1 is a somewhat diagrammatic side view of a suspension structure particularly for use in running pumping and other hardware into a well.

Referring in detail to the drawings, a suspension structure for the purpose indicated is referred to generally by reference numeral 10. The structure includes a base member 12 defining an upper mounting surface, the base member being for example a platform or deck at a wellhead 14, or being a portable skid-mounted unit. On base member 12 are mounted a first suspension mast assembly A, a second suspension mast assembly B, and a cable drive system C.

Figure 4:
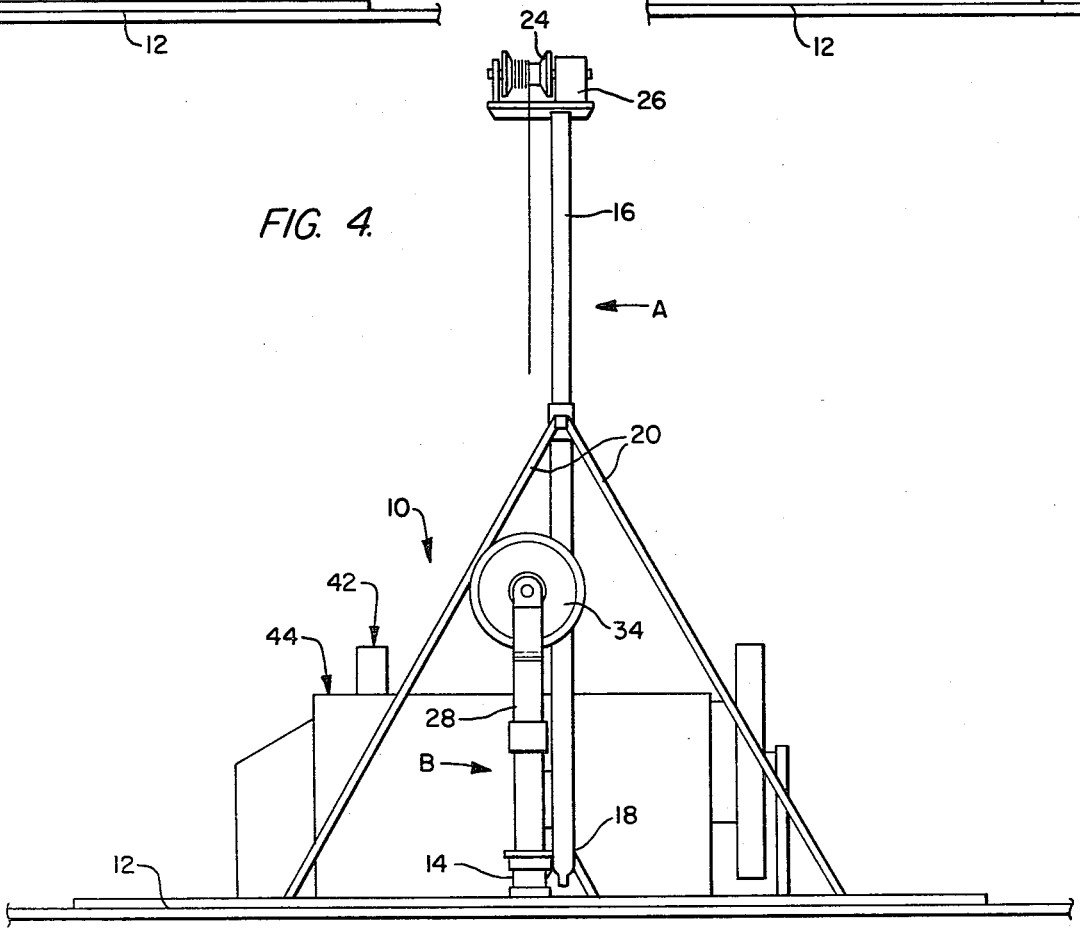
FIG. 4 is an end view of the structure as shown in FIG. 3.

The first mast assembly A includes a first suspension mast 16, which may be pivotally mounted on base member 12 as indicated at 18 in FIG. 4, and support means 20 for mast 16. Support means 20 may, for example, comprise extensible and retractable posts releasably connected to mast 16 and pivotally connected to base member 12, or the support means may alternatively include one or more hydraulic rams. The precise construction of mast 16 and support means 20 is not critical and numerous forms of construction, as known in the prior art, may be used for this assembly. The only criterion is that the mast 16 should be of sufficient height to permit suspension therefrom of the particular well hardware, such as a pumping assembly, for which the structure is designed, in such a manner that the hardware is supported above wellhead 14 and the mast must of course be capable of supporting the weight of such hardware, its associated running gear, and the mast cable and drive system. Mast 16 may, for example, comprise a conventional form of tubular telescopic mast.

Atop mast 16 is mounted, again in conventional manner, a cable running means including a winch 24 and winch drive 26. In use, a suitable cable with a connector for the well hardware is carried by the winch. The winch and winch drive also need only be of sufficient power to support the weight of, and run the well hardware with which the structure will be used.

The second mast assembly B includes a second suspension mast 28, which may also be pivotally mounted on base member 12 as shown at reference 30, and support means 32. Mast 28 is, as shown, shorter than mast 16 and whereas mast 16, to accommodate a well pumping assembly approaching 45 feet in length, would typically have a working height above wellhead 14 of the order of 50 feet, mast 28 would typically only have a working height of the order of about 20 feet. Mast 28, however, is of generally heavier construction than mast 16 so as to be capable of withstanding the maximum forces developed in pulling for example a well pumping assembly from a well. Again, the precise construction of mast 28 is not critical and can follow established practice used for single-mast oil well pulling equipment. Since this mast, however, is much shorter than equivalent masts in single-mast systems, it may be of lighter construction to obtain an equivalent load capacity.

Atop mast 28 is a cable running means in the form of a conventional crown wheel 34, and, as is known in the art, mast 28 may include internal hydraulic means providing additional lift pressure to the crown wheel.

Figure 2:
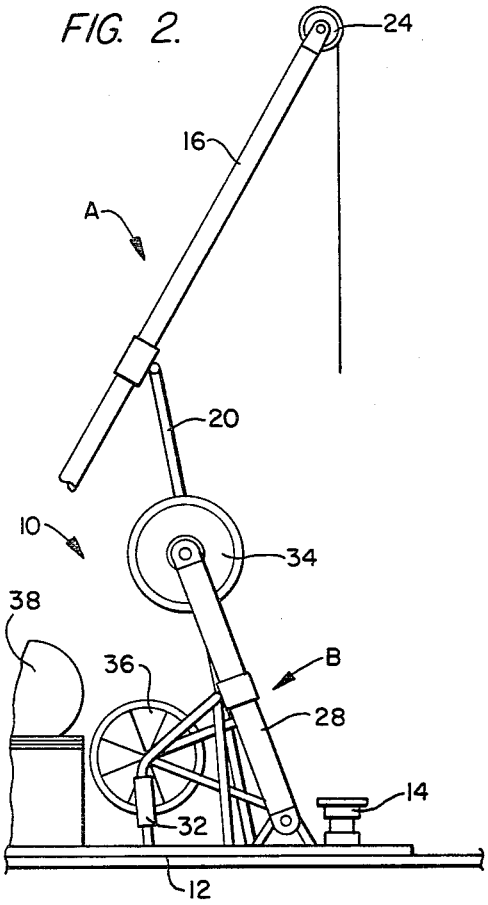
FIG. 2 is a view similar to FIG. 1 of an end section of the structure shown in a different operating mode.

Support means 32 for mast 28 may also comprise a known form of hydraulic system for supporting the mast in the operative position as shown in FIG. 1 and for pivoting the most to an inoperative position as shown in FIG. 2. In the operative positions of the respective masts, the crown wheel 34 and winch 24 are mutually aligned so that cables can be run from the respective masts substantially coaxially down the well.

Figure 3:
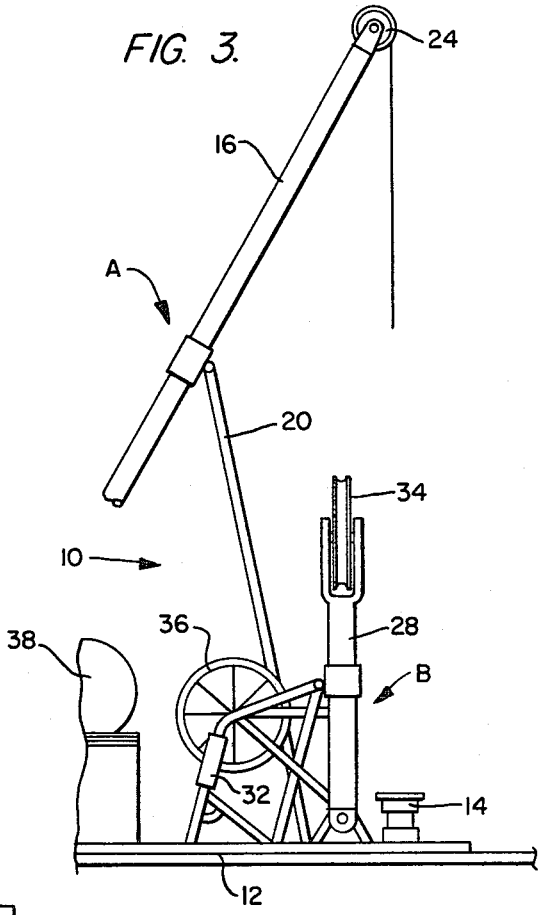
FIG. 3 is a view similar to FIG. 2 showing a modification in the structure.

As an alternative to pivoting the mast 28 away from the operative position about pivot 30, as shown in FIG. 2, the upper section of the mast can be made to swivel about its axis, as shown in FIGS. 3 and 4, to move the crown wheel 34 from the operative position.

In use, mast 28 is provided with a suitable running and pulling cable operated in conventional manner by drive system C. The latter system may, as is known in the art, include a floor sheave 36, power-driven tensioning sheaves 38 and 40 around which the cable passes in a figure-8 configuration, and a driven cable drum 42. Hydraulic power for operating sheaves 38 and 40, drum 42, winch 24 and for raising, lowering and adjusting the position of the mast may be provided by a power unit 44 comprising a prime mover-driven hydraulic pump. Drive systems of this type and also the general construction and configuration of mast 28 and its support means 32 may, as indicated, be of well known type as exemplified by systems currently offered by TRW Reda Pump Division, Bartlesville, OK.

In operation, for example, for running a pump assembly into a well, the pump assembly may be assembled and serviced in situ using mast 16 for suspension, and with mast 28 in the inoperative position. Upon completion of the assembly and service operation, winch 28 is operated to lower the pump assembly to a level at which it can be connected to the cable of mast 28. Mast 28 is moved into operative position and its cable connected to the pump assembly allowing the cable of mast 16 to be disconnected. The pump assembly is then run into the well in conventional manner using mast 28 and drive system C. For pulling the pump assembly from the well, for inspection, servicing or the like, the above procedure is reversed.

While only preferred embodiments of the invention have been described herein in detail, it will be understood that the invention is not limited thereby and modifications may be made within the scope of the attached claims.

I claim:

1. In combination with a well, a system for running well hardware into the well by cable or the like and pulling the hardware from the well, the system comprising a suspension structure including a base means, suspension mast means mounted on said base means, said mast means including means for suspending the hardware from a first location having a height above said base means which is greater than the height of the hardware, means for suspending the hardware from a second location above said base means and below said first location, said second location having a height above the base means which is substantially less than the height of the hardware, said first and second locations being substantially vertically aligned, means for running the hardware toward the well from said first and second locations, means for applying a pulling force on the hardware when suspended in a well for pulling the hardware therefrom, and said mast means having a construction providing sufficient strength to withstand the maximum pulling force when said force is applied from said second location and insufficient strength to withstand the maximum pulling force if said force is applied from said first location, wherein said suspension mast means includes first and second masts defining said first and second locations, respectively, said first mast having a height sufficient to suspend said hardware above said base means and a strength insufficient to withstand said maximum pulling force, said second mast having a height insufficient to suspend said hardware above said base means and a strength sufficient to withstand said maximum pulling force.

* * * * *